United States Patent [19]

Rossi

[11] Patent Number: 4,569,679

[45] Date of Patent: Feb. 11, 1986

[54] ADDITIVE CONCENTRATES FOR DISTILLATE FUELS

[75] Inventor: Albert Rossi, Warren, N.J.

[73] Assignee: Exxon Research & Engineering Co., Florham Park, N.J.

[21] Appl. No.: 588,645

[22] Filed: Mar. 12, 1984

[51] Int. Cl.[4] ..... C10L 1/18

[52] U.S. Cl. ..... 44/62; 44/70; 44/71; 44/66

[58] Field of Search ..... 44/62, 70, 71, 66

[56] References Cited

U.S. PATENT DOCUMENTS

| | | | |
|---|---|---|---|
| 3,850,587 | 11/1974 | Frost, Jr. | 44/70 |
| 3,961,915 | 6/1976 | Wisotsky | 44/70 |
| 3,982,909 | 9/1976 | Hollyday, Jr. | 44/71 |
| 4,087,255 | 5/1978 | Wisotsky et al. | 44/70 |
| 4,210,424 | 7/1980 | Feldman et al. | 44/70 |
| 4,211,534 | 7/1980 | Feldman | 44/70 |

FOREIGN PATENT DOCUMENTS

| | | |
|---|---|---|
| 0061894 | 10/1982 | European Pat. Off. . |
| 1010714 | 11/1965 | United Kingdom . |

OTHER PUBLICATIONS

Serial No. 532,319, by Albert Rossi and Kenneth Lewtas, application and allowed claims.

Kirk-Othmer Encyclopedia of Chemical Technology, Third Edition, vol. 17, p. 373 and cover page.

*Primary Examiner*—Y. Harris-Smith

*Attorney, Agent, or Firm*—Frank T. Johmann

[57] ABSTRACT

An additive concentrate for incorporation into wax containing petroleum fuel oil compositions to improve low temperature flow properties comprising an oil solution containing:

(A) a $C_{30}$–$C_{300}$ oil-soluble nitrogen salt and/or amide compound wax crystal growth inhibitor formed by reaction of alicyclic $C_4$ to $C_{10}$ carboxylic acid and long chain secondary amine;

(B) an organic acid to improve the solubility of (A) in the oil, which acid includes non-linear carboxylic acids including branched or unsaturated fatty acids, aromatic acids, e.g. benzoic acid, phenols, and organic phosphorus containing acids; and (C) a copolymer of ethylene and an unsaturated ester, e.g. vinyl acetate.

13 Claims, No Drawings

ADDITIVE CONCENTRATES FOR DISTILLATE FUELS

BACKGROUND OF THE INVENTION

1. Field of the Invention

This invention relates to additives to improve the flow and filterability properties of distillate fuels at low temperatures, to fuels containing the additives and especially to concentrates of the additives for incorporation into the fuel. Particularly, the invention relates to an additive concentrate comprising an oil solvent, an ethylene-ester copolymer, a nitrogen-containing amide and/or salt of an aliphatic dicarboxylic acid or anhydride, and an oil soluble compatibility improving additive which lowers the pour point of said concentrate and which improves the compatibility of said copolymer and said nitrogen compound.

2. Description of the Prior Art

Additive systems and concentrates comprising nitrogen containing amide or amine salts as used in the present invention are disclosed in U.S. Pat. No. 4,211,534 which discloses an additive flow improver of an ethylene polymer or copolymer, a second polymer of an oil soluble ester and/or $C_3$ and higher olefin polymer and a nitrogen containing compound.

European patent application No. 82301556.5 having Publication No. 0061894 discloses the use of nitrogen containing compounds in combination with certain ethylene/vinyl acetate copolymers as distillate additives which may be supplied in the form of concentrates.

U.S. Pat. No. 3,982,909 discloses an additive system comprising amides, diamides and ammonium salts alone, or in combination with certain hydrocarbons such as microcrystalline waxes or petrolatums, and/or an ethylene backbone polymeric pour depressant, the combination being useful as a flow improver for middle distillate fuels.

U.S. Pat. No. 3,850,587 shows use of certain acids, especially aromatic acids, to improve the compatibility of the amine salt/amides of alkenyl succinic acid and ethylene-vinyl acetate copolymers in oil concentrates used for incorporation into distillate fuels.

BRIEF SUMMARY OF THE INVENTION

While nitrogen containing derivatives of aliphatic polycarboxylic acids are effective in inhibiting wax crystal growth and as cold flow improving additives, along with ethylene-unsaturated ester copolymers, they usually have low solubilities and tend to crystallize out of oil concentrates at ambient temperatures rendering the concentrate difficult to use. Also, they tend to interact with the copolymer of ethylene and unsaturated ester, e.g. copolymer of ethylene and vinyl acetate, to thicken the oil concentrate. In fact, they can gel the concentrate to a solid in some cases. This interaction can require excessive amounts of solvent or diluent oil in order to keep the concentrate fluid so it can be easily poured and handled. The present invention is based on the discovery that the fluidity and pour point of an additive concentrate containing a copolymer of ethylene and unsaturated ester, with an amine salt, e.g. an alkyl ammonium, or amide compound, having a total of 30–200, preferably 50–150 carbon atoms, derived from certain aliphatic carboxylic acids or anhydrides, optionally in combination with still other additives, may be improved by the incorporation of certain compatibility improving agents.

Composition Of The Invention

Concentrates may be prepared comprising: (A) one part by weight of the oil-soluble nitrogen compound which may be amides and/or amine salts of acyclic aliphatic carboxylic acids or ammonium salts of said acids or anhydrides thereof; (B) 0.005 to 1.0, e.g. 0.01 to 0.4, preferably 0.02 to 0.10 parts by weight of an oil-soluble acidic compound which acts as a compatibility improver agent; and (C) about 0.01 to 10, e.g. 0.03 to 5, preferably 0.05 to 5 parts by weight of oil-soluble ethylene-unsaturated ester distillate flow improver copolymer. Concentrates in a mineral oil as a solvent and/or diluent, such as naphtha, of 30 to 80, preferably 40 to 70 wt. % of the additive combination (A), (B) and (C) will generally be used. Aromatic solvents or aromatic containing oils, such as heavy aromatic naphtha (HAN) are particularly suitable for dissolving the aforesaid components to make concentrates.

The concentrates may also contain still other additives, in the additive mixture besides (A), (B) and (C) such as 0.01 to 10 parts by weight of each other additive, per part by weight of said nitrogen compound. Examples of other additives include other polymers including polyesters such as polyacrylates or polymethacrylates, and the other polymers described in col. 6, line 57 to col. 10, line 6 of U.S. Pat. No. 4,210,424; waxes such as normal paraffin waxes, slack waxes, foots oil and other waxes as described in col. 4, line 39 to col. 5, line 16 and col. 11, line 45 to col. 12, line 6 of U.S. Pat. No. 4,210,424; hydrocarbon polymers including ethylene-propylene copolymers, polyisobutylene as well as other hydrocarbon polymers; as well as other conventional additives found useful in treating fuel oil.

The flow improver concentrates of the present invention may be incorporated into a broad category of petroleum fuel oils, especially distillate fuels boiling in the range of about 120° C. to about 500° C. (ASTM D1160), preferably those distillate fuels boiling in the range of about 150° C.–400° C. to improve their flow properties. The most common petroleum distillate fuels are kerosene, jet fuels, diesel fuels and heating oils. Low temperature flow properties are most usually encountered with diesel fuels and with heating oils.

The concentrates will generally be included in the fuel to give a total additive concentration of (A), (B) and (C) in the fuel of about 0.001 to 0.5 wt. %. Excellent results are usually achieved with said total additive concentrations in range of 0.005 to 0.25 wt. %, preferably in the range of about 0.005 to 0.05 wt. %. All said weight percents being based upon the weight of distillate fuel.

The Nitrogen Compound

The nitrogen-containing wax crystal growth inhibitors used in the compositions of the invention are generally those having a total of 30–300, preferably 50–150 carbon atoms, and being oil-soluble amine salts and/or amides formed by reacting at least 1, generally at least 2, molar portions of a hydrocarbyl substituted amine per molar portion of the aliphatic acyclic polycarboxylic acid, e.g. 2 to 4 carboxyl groups preferably dicarboxylic acids, or their anhydrides. All acid groups may be converted to amine salts or amides, or part of the acid groups may be converted to esters by reaction with hydrocarbyl alcohols, or part of the acid groups may be left unreacted.

Examples of aliphatic, acyclic carboxylic acids used to prepare these materials include $C_4$ to $C_{10}$, e.g. $C_4$, saturated, but preferably unsaturated, aliphatic hydrocarbyl carboxylic acids, such as: maleic, fumaric, succinic, succinic anhydride, adipic, glutaric, sebacic, malonic, citric, derivatives and mixtures of the foregoing, etc.

Preferred amines used to prepare the amine salts and/or amides include alkyl amines having alkyl groups of $C_8$ to $C_{30}$ carbon atoms, preferably 10 to 24 carbon atoms, preferably secondary amines.

Amine mixtures may also be used and many amines derived from natural materials are mixtures. Thus, coco amine derived from coconut oil is a mixture of primary amines with straight chain alkyl groups ranging from $C_8$ to $C_{18}$. Another example is tallow amine, derived from hydrogenated tallow, which amine is a mixture of $C_{14}$ to $C_{18}$ straight chain alkyl groups.

To prepare the ester derivatives, preferably $C_8$ to $C_{30}$, e.g. $C_{10}$ to $C_{24}$, saturated or unsaturated aliphatic, hydrocarbyl alcohols can be used, including cracked wax Oxo-alcohols, and aldol derived alcohols. Specific examples of these alcohols include 1-tetradecanol, 1-hexadecanol, 1-octadecanol, $C_{12}$ to $C_{18}$ Oxo alochols made from a mixture of cracked wax olefins, 1-hexadecanol and 1-octadecanol, etc.

The amides can be formed in a conventional manner by heating the amine and acid with the removal of any water generated by the action. Similarly the monoester is prepared in a conventional manner by heating the alcohol and the acid to effect the reaction and promote removal of the water of reaction if generated from the reaction environment. The salts are also conventionally prepared by simply mixing secondary amine and the acid, or acid anhydride, or monoester or monoamide of the acid, together with stirring at room temperature, e.g. 25° C.

Particularly preferred are nitrogen compounds of the above type that are prepared from dicarboxylic acids, which appear to be generally more effective than compounds prepared from monocarboxylic acids or tricarboxylic acids.

It is preferred that the nitrogen containing compound has at least one straight chain alkyl segment extending from the compound containing 8–30, preferably 10–24 carbon atoms. Preferably the nitrogen compound contains at least three alkyl chains each containing from 8 to 30 carbon atoms and preferably at least two of these chains are normal. Also at least one ammonium salt, amine salt or amide linkage is required to be present in the molecule. The particularly preferred compound is the amide-amine salt formed by reacting 1 molar portion of maleic anhydride with 2 molar portions of dihydrogenated tallow amine. Another preferred embodiment is the diamide formed by dehydrating this amide-amine salt.

The Compatibility Improver

The acids for use in the concentrates of the present invention are oil-soluble organic acids, including their anhydrides, containing 3 to 100, e.g. 6 to 30, preferably 6 to 24 carbons and having 1 to 3, preferably 1 to 2 acid groups. While their method of operation is not fully understood, it is believed that they may inhibit the interaction of the basic nitrogen compound with the ethylene-unsaturated ester copolymer to hinder gelling or undue viscosity increase of the oil. Examples of suitable acids include non-linear carboxylic acids which may be aromatic, aliphatic, branched, or unbranched, saturated or unsaturated, substituted or unsubstituted, provided that the acid is non-linear e.g. that it is not straight chain, saturated and non-substituted. Aromatic carboxylic acids appear especially useful as are phenols, and phosphorus acids. Preferred are weak acids such as fatty acids, benzoic acid, phenol, alkyl phenols, dicarboxylic acids such as maleic anhydride, alkenyl or alkyl succinic acid or anhydride, organic phosphates such as dialkyl, mono acid phosphate, etc.

The Ethylene Copolymer

The ethylene copolymers are of the type known in the art as wax crystal modifiers, e.g. pour depressants and cold flow improvers for distillate fuel oils. Usually, they will comprise about 3 to 40, preferably 4 to 20, molar proportions of ethylene per molar proportion of ethylenically unsaturated ester monomer, which latter monomer can be a single monomer or a mixture of such monomers in any proportion. These polymers will generally have a number average molecular weight in the range of about 500 to 50,000, preferably about 1000 to 20,000, e.g. 1000 to 6000, as measured for example by Vapor Pressure Osmometry (VPO), such as using a Mechrolab Vapor Pressure Osmometer Model 302B.

The unsaturated monomers, copolymerizable with ethylene, include unsaturated mono and diesters of the general formula:

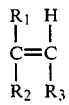

wherein $R_1$ is hydrogen or methyl; $R_2$ is a —$OOCR_4$ or —$COOR_4$ group wherein $R_4$ is hydrogen or a $C_1$ to $C_{28}$, more usually $C_1$ to $C_{16}$, and preferably a $C_1$ to $C_8$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_1$ to $C_{29}$, more usually $C_1$ to $C_{17}$, monocarboxylic acid, and preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and either or both of $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate, di-lauryl fumarate, ethyl methyl fumarate, etc. It is preferred, however, that the acid groups be completely esterified as free acid groups tend to promote haze if moisture is present in the oil.

Copolymers of ethylene and unsaturated esters, and methods for their manufacture, are well known in the art of distillate flow improvers and have been described in numerous patents such as U.S. Pat. Nos. 4,211,534; 3,961,916; and 4,087,255. Copolymers of ethylene and vinyl acetate are particularly preferred.

Oil-soluble, as used herein, means that the additives are soluble in the fuel at ambient temperatures, e.g., at least to the extent of about 0.01 wt. % additive in the fuel oil at 25° C., although at least some of the additive comes out of solution near the cloud point in order to modify the wax crystals that form.

The invention will be further understood by reference to the following Example which includes preferred embodiments of the invention.

EXAMPLE 1, PART A

In carrying out this example, the following additive materials were used:

Polymer 1

Polymer 1 used in this example an ethylene-vinyl acetate copolymer of about 62 wt. % ethylene and about 38 wt. % vinyl acetate, which had a number average molecular weight of about 1800 (VPO). It is identified in said U.S. Pat. No. 3,961,916 as Copolymer B of Example I (column 8, lines 25–35).

Nitrogen Compound A

Nitrogen Compound A was a diamide of maleic anhydride and secondary hydrogenated amine formed by reacting one mole of maleic anhydride with two moles of Armeen 2HT with heating in a solvent to a temperature sufficient to remove all the water and thereby form the diamide in accordance with U.S. Pat. No. 3,982,909.

The secondary hydrogenated tallow amine, derived from tallow fat is a commercially available product sold by Armak Co., Chemicals Division, Chicago, Ill. and designated Armeen 2HT. This amine has the formula:

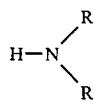

where the R's are straight chain alkyl groups derived from hydrogenated tallow and are about 4% $C_{14}$ alkyl groups, 31% $C_{16}$ alkyl groups and 59% $C_{18}$ alkyl groups.

Heavy Aromatic Naphtha (HAN)

This is a useful solvent for the multicomponent additives of the invention and typically has an aniline point of 24.6° C., a specific gravity (°API) of 0.933, a boiling range of 179° C. to 235° C. and is composed of 4 wt. % paraffins, 6.7 wt. % naphthenes, 87.3 wt. % aromatics, e.g. polyalkyl aromatics, and 2.0 wt. % olefins.

Concentrates A, B and C

Concentrates A, B, and C were prepared consisting of the active ingredient (a.i.) Polymer 1 and Nitrogen Compound A, dissolved in HAN, wherein one part by weight of Compound A was used per part by weight of Polymer 1. The amount of HAN was adjusted to give 53 wt. % HAN (Concentrate A); 51% (Concentrate B) and 67% (Concentrate C). These concentrates were then tested for pour point (ASTM D-97) and the results are summarized in Table 1.

TABLE I

Effect of Additive Concentration on Pour Point

| Concentrate | WT. % a.i. | Wt. % HAN | Appearance | ASTM Pour, °F. |
|---|---|---|---|---|
| A | 47 | 53 | Solid | 90 |
| B | 49 | 51 | Solid | 85 |
| C | 33 | 67 | Liquid | 60 |

As seen by Table I, 33% active ingredient content of the concentrate gave a liquid concentrate at room temperature with a pour point of 60° F. However, when the active ingredient level was increased to form a more economical concentrate, the concentrate gelled to form a solid, apparently due at least in part to an interaction or attraction between the ethylene-vinyl acetate copolymer, and the nitrogen compound.

EXAMPLE I, PART B

Various auxiliary additives mixed into the concentrates (by mixing for one hour at 120°–130° F.) were found to be effective in lowering the pour point of the concentrates by improving the compatibility, e.g. inhibiting the interaction of the ethylene-unsaturated ester copolymer and the nitrogen compound. The effect of adding these auxiliary materials to said concentrates are shown in Table II, which follows.

TABLE II

EFFECT OF COMPATIBILITY IMPROVERS

| Wt. % Additive | Concentrate Wt. % A.I. | Concentrate Wt. % HAN | Pour Point, °F. ASTM |
|---|---|---|---|
| 0.5 Benzoic Acid | 49.7 | 49.7 | 65 |
| 1.0 Benzoic Acid | 49.5 | 49.5 | 45 |
| 2.0 Benzoic Acid | 49.0 | 49.0 | 40 |
| 4.0 Benzoic Acid | 47.0 | 49.0 | 40 |
| 0.5 Isobutyric Acid | 49.7 | 49.7 | 75 |
| 4.0 Isobutyric Acid | 47.0 | 49.0 | 40 |
| 0.5 Oleic Acid | 49.7 | 49.7 | 85 |
| 4.0 Oleic Acid | 47.0 | 49 | 45 |
| 0.5 Phenol | 49.7 | 49.7 | 85 |
| 1.0 Phenol | 49.5 | 49.5 | 75 |
| 2.0 Phenol | 49 | 49 | 70 |
| 4.0 Phenol | 47 | 49 | 40 |
| 0.5 P—Methoxy Phenol | 49.7 | 49.7 | 85 |
| 4.0 P—Methoxy Phenol | 47 | 49 | 50 |
| 0.5 Maleic Anhydride | 49.7 | 49.7 | 45 |
| 4.0 Maleic Anhydride | 47.0 | 49 | 2 phases |
| 0.5 $C_8$ Alkyl Succ. Anhydride | 49.7 | 49.7 | 65 |
| 4.0 $C_8$ Alkyl Succ. Anhydride | 47.0 | 49 | 40 |
| 0.5 Tetraisobutyl Succ. Anhydride | 49.7 | 49.7 | 80 |
| 4.0 Tetraisobutyl Succ. Anhydride | 47.0 | 49 | 40 |
| 0.5 Tetrapropyl Succ. Anhydride | 49.7 | 49.7 | 65 |
| 4.0 Tetrapropyl Succ. Anhydride | 47.0 | 49 | 40 |
| 0.5 Polyisobutenyl (900 mw) Succ. Anhydride | 49.7 | 49.7 | 90 |
| 4.0 Polyisobutenyl (900 mw) Succ. Anhydride | 47.0 | 49 | 65 |
| 0.5 Tridecyl Mono Acid Phosphate | 49.7 | 49.7 | 70 |
| 4.0 Tridecyl Mono Acid Phosphate | 47.0 | 49 | 45 |

Looking at Table II, when 0.5 wt. % benzoic acid was mixed with 99.5 wt. % of the concentrate (which was 49.75 wt. % of HAN and 49.75 wt. % of a 50/50 weight mixture of Nitrogen Compound A and Polymer 1) the pour point was 65° F. Table I shows that this represented an improvement since Concentrates A and B were solid at room temperature (about 70° F.) and had pour points of 85°–90° F. Increasing the benzoic acid to 4.0 wt. % gave a 40° F. pour point.

Maleic anhydride was very effective at 0.5 wt. %, although the higher concentration of 4.0 wt. % caused the concentrate to separate into two phases as noted. The various succinic anhydrides were effective, although as the hydrocarbon portion increased from the $C_8$ alkyl group to the 900 molecular weight polyisobutylene group, the effectiveness decreased.

In summary, the use of a mild or weak organic acid appears to inhibit the viscosity increasing interaction of the polar nitrogen compound with the ethylene-ester copolymer. This enables the preparation of concentrates with a higher proportion of active ingredient present while still having good handling properties, e.g. easy to pour or to empty out of the drum or container.

What is claimed is:

1. An additive concentrate for incorporation into wax containing petroleum fuel oil compositions to improve low temperature flow properties, comprising an oil solution containing about 20 to 70 wt. % diluent oil, and 30 to 80 wt. % of an additive combination of:

(A) one part by weight of a $C_{30}$–$C_{300}$ oil-soluble diamide formed by reaction of about two molar proportions of alkyl amine having $C_8$ to $C_{30}$ alkyl groups with one molar proportion of a $C_4$ to $C_{10}$ aliphatic acyclic dicarboxylic acid;

(B) in the range of about 0.005 to 1.0 parts by weight of an oil soluble organic acid of 6 to 30 carbon atoms, and one to three acid groups, selected from the group consisting of non-linear carboxylic acid, their anhydrides, phenols, and organic acids of phosphorus; and (C) in the range of about 0.01 to 10 parts by weight of an oil-soluble ethylene backbone distillate flow improving polymer having a number average molecular weight in the range of about 500 to 50,000 which is a copolymer consisting essentially of 3 to 40 molar proportions of ethylene per molar proportion of unsaturated ester of the general formula:

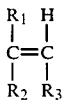

wherein $R_1$ is methyl or hydrogen, $R_2$ is —$OOCR_4$ or —$COOR_4$ where $R_4$ is a $C_1$ to $C_{28}$ alkyl group and $R_3$ is hydrogen or —$COOR_4$;

and wherein said organic acid lowers the viscosity of said oil containing (A) and (C).

2. An additive concentrate according to claim 1, wherein the amount of (B) is in the range of about 0.01 to 0.4 parts, and the amount of (C) is about 0.03 to 5 parts.

3. An additive concentrate according to claim 2, in which the ethylene copolymer is an ethylene-vinyl acetate copolymer which contains from 4 to 20 molar portions of ethylene per molar portion of vinyl acetate, and has a number average molecular weight from 1,000 to 20,000.

4. An additive concentrate according to claim 3, in which the diamide is obtained by the reaction of maleic anhydride with secondary di(hydrogenated tallow) amine.

5. An additive concentrate according to claim 4, in which the organic acid (B) is an aliphatic carboxylic acid.

6. An additive concentrate according to claim 4, in which the organic acid (B) is an aromatic carboxylic acid.

7. An additive concentrate according to claim 4, wherein said organic acid (B) is an alkyl or alkenyl succinic anhydride.

8. An additive concentrate according to claim 4 wherein said organic acid (B) is a fatty acid.

9. An additive concentrate according to claim 4, wherein said organic acid (B) is a phenol.

10. An additive concentrate according to claim 4, wherein said organic acid (B) is a phosphorus acid.

11. A distillate fuel oil containing said additive concentrate of claim 1, in such proportion as to give about 0.001 to 0.5 wt. % total of said (A), (B) and (C) components.

12. A distillate fuel according to claim 11, wherein: (A) is the diamide of maleic anhydride and secondary hydrogenated tallow amine and (C) is a copolymer of 3 to 20 molar proportions of ethylene per molar proportion of vinyl acetate having a number average molecular weight of 1000 to 6000.

13. An additive concentrate for incorporation into wax-containing petroleum fuel oil compositions to improve low temperature flow properties, comprising an oil solution containing about 20 to 70 weight % diluent oil, and about 30 to 80 weight % of an additive combination of:

(A) about one part by weight of a diamide of maleic anhydride and secondary hydrogenated tallow amine obtained by the reaction of about 2 molar proportions of said amine per molar proportion of said maleic anhydride;

(B) 0.01 to 0.4 parts of benzoic acid; and (C) about 0.03 to 5 parts of an ethylene vinyl acetate copolymer of 4 to 20 molar proportions of ethylene per molar proportion of vinyl acetate, such copolymer having a number average molecular weight of about 1,000 to 6,000; and wherein said benzoic acid lowers the viscosity of said diluent oil containing (A) and (C).

* * * * *